US005584273A

United States Patent [19]

Halsig

[11] Patent Number: 5,584,273

[45] Date of Patent: Dec. 17, 1996

[54] THROTTLE VALVE ACTUATOR WITH NON-LINEAR TO LINEAR CAM OPERATION

[75] Inventor: Michael J. Halsig, Warren, Mich.

[73] Assignee: Coltec Industries Inc., New York, N.Y.

[21] Appl. No.: 566,871

[22] Filed: Dec. 4, 1995

[51] Int. Cl.[6] ..... F02D 9/08

[52] U.S. Cl. ..... 123/400

[58] Field of Search ..... 123/400, 399, 123/339, 361, 403, 396; 74/513, 96; 251/279, 289, 295

[56] References Cited

U.S. PATENT DOCUMENTS

| | | | |
|---|---|---|---|
| 4,787,353 | 11/1988 | Ishikawa et al. | 123/399 |
| 4,985,874 | 8/1990 | Nishitani et al. | 123/400 |
| 5,161,507 | 11/1992 | Terazawa et al. | 123/399 |
| 5,178,112 | 1/1993 | Terazawa et al. | 123/399 |
| 5,263,449 | 11/1993 | Swartzendruber | 123/400 |
| 5,297,522 | 3/1994 | Buchl | 123/399 |
| 5,367,997 | 11/1994 | Kawamura et al. | 123/399 |

*Primary Examiner*—Raymond A. Nelli
*Attorney, Agent, or Firm*—Howard S. Reiter, Esq.

[57] ABSTRACT

A throttle valve actuator for an internal combustion engine includes a throttle body for defining at least one aperture or passageway extending therethrough to deliver a charge to a combustion chamber in communication with the aperture. At least one valve is mounted on a shaft for rotating within the aperture of the throttle body to control the internal combustion engine. A crank arm is connected to the shaft for driving the valve in rotation between a first position and a second position. A pliant cable is connected to the crank arm at an anchor point adjacent one end of the pliant cable. The pliant cable transmits a force to the crank arm to control rotation of the valve connected thereto. A cam is connected to the crank arm for modifying an effective moment arm of force being transmitted between the pliant cable and the crank arm, such that the moment arm rapidly decreases during a first angular portion of rotation about the shaft from the first or closed position and substantially stabilizes during a second angular portion of rotation about the shaft to the second or open position.

20 Claims, 5 Drawing Sheets

THROTTLE VALVE ACTUATOR WITH NON-LINEAR TO LINEAR CAM OPERATION

FIELD OF THE INVENTION

The invention relates to a throttle valve actuator which is mounted on a valve shaft of a throttle valve, and more particularly, to a cam for modifying an effective moment arm of force being transmitted between a pliant cable and the throttle valve actuator so that the moment arm rapidly decreases during a first angular portion of rotation about the throttle shaft from the closed position and substantially stabilizes during a second angular portion of rotation about the shaft to the open position.

BACKGROUND OF THE INVENTION

In an internal combustion engine, a throttle body defines an aperture extending therethrough to deliver a charge to a compression chamber in communication with the aperture. A valve typically is mounted on a shaft for rotation within the aperture of the throttle body to control the internal combustion engine. Rotation of the throttle shaft causes variation in the flow area around the valve member. A crank arm is typically connected to the shaft for driving the valve member in rotation between a closed position and an open position. A throttle cable is coupled at one end to the crank arm and at an opposite end to an accelerator pedal. Displacement of the accelerator pedal causes rotation of the crank arm and throttle shaft thereby varying the flow area around the throttle valve. The crank arm is mounted typically on an end of the throttle shaft outside of the throttle body so that the crank arm can rotate between a closed position wherein the flow area around the valve is minimum and an open position where the flow area is increased. When a tensile force is applied to the pliant cable connected to the crank arm by displacement of the accelerator pedal, the force causes the throttle valve to rotate away from the closed position toward an open position. A return spring is typically connected to the throttle shaft, so that when tensile force through the pliant cable is decreased, the return spring urges the throttle valve to rotate toward the closed position. It is also known to provide connections to the throttle shaft, typically on the crank arm, for cruise control systems and/or automatic transmission shifting control systems.

SUMMARY OF THE INVENTION

It is desirable in the present invention to provide a throttle valve actuator for modifying an effective moment arm of force being transmitted between the pliant cable and the crank arm, so that the moment arm rapidly decreases during a first angular portion of rotation about the throttle shaft from the closed position and substantially stabilizes during a second angular portion of rotation about the throttle shaft to the open position. This decreases the sensitivity of the accelerator pedal at low speeds to reduce the tendency of the engine to surge or be overly sensitive to initial depression of the accelerator pedal from the throttle closed position.

According to the present invention, a throttle valve actuator is provided for an internal combustion engine including a throttle body for defining at least one aperture or passageway extending therethrough to deliver a charge to a combustion chamber in communication with the aperture. At least one valve member is mounted on a shaft for rotation within the aperture of the throttle body to control the internal combustion engine. A crank arm is connected to the shaft for driving the valve in rotation between a first or closed position and a second or open position. A pliant cable is connected to the crank arm at an anchor point adjacent one end of the pliant cable. The pliant cable transmits a force to the crank arm to control rotation of the valve in response to depression of the accelerator pedal. A cam is connected to the crank arm for modifying an effective moment arm of force being transmitted between the pliant cable and the crank arm, such that the moment arm rapidly decreases during a first angular portion of rotation about the throttle shaft from the closed position and substantially stabilizes during a second angular portion of rotation about the throttle shaft to the open position.

The first angular portion of rotation about the throttle shaft is preferably in a range of between approximately 30° and approximately 40° inclusive. The second angular portion of rotation about the throttle shaft is preferably in a range of between approximately 45° and approximately 55° inclusive. The first or closed position of the throttle valve is generally disposed at an angular position corresponding to 0° while the second or open position of the throttle shaft is generally disposed at an angular position corresponding to 85°.

The cam can be spaced from the anchor point of the pliant cable on the crank arm. The cam can also be selectively engageable with the pliant cable during the first angular portion of rotation about the throttle shaft and disengaged from the pliant cable during the second angular portion of rotation about the throttle shaft. The cam preferably has a notch or trough-shaped cable guide formed therein for receiving the pliant cable when in at least the closed position of the throttle valve. In the preferred embodiment, the notch extends along only a portion of the length of the pliant cable and is spaced from the anchor point of the pliant cable on the crank arm. The notch or cable track in the cam can include a trough-shaped guide having a bottom extending along a portion of the longitudinal length of the pliant cable with one end preferably spaced from the anchor point, or alternatively adjacent to the cable connection to the crank arm, and a pair of walls extending outwardly from the bottom of the cable guide.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
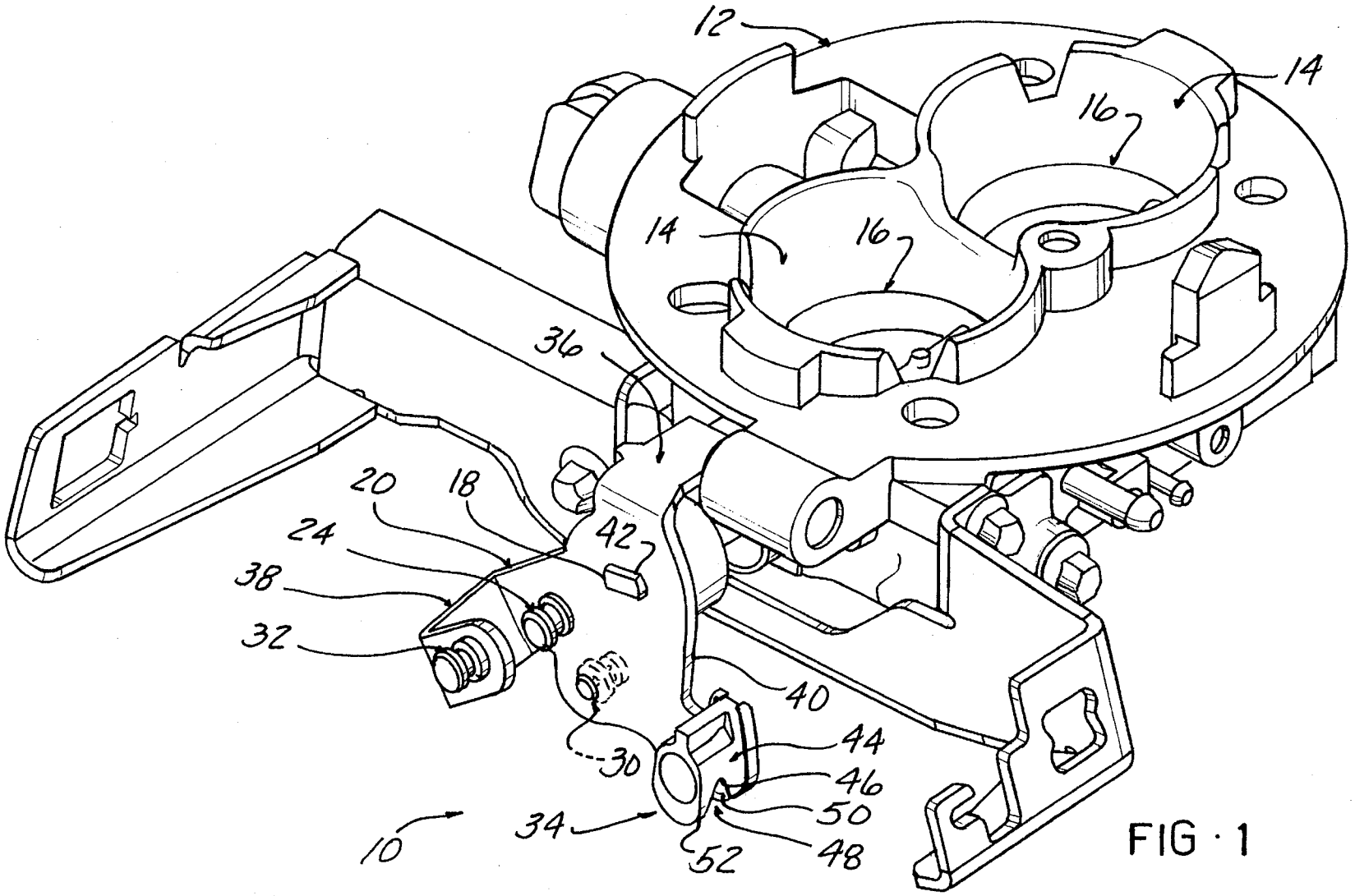
FIG. 1 is a perspective view of a throttle valve actuator according to the present invention mounted on a shaft rotatably connected to a throttle body supporting a throttle valve of an internal combustion engine with the pliant throttle cable not shown.

A throttle valve actuator 10 according to the present invention is illustrated in FIGS. 1–6. The present invention is adapted for use on a conventional internal combustion engine having throttle body means 12 for defining at least one passageway or aperture 14 extending therethrough to deliver a charge to a combustion chamber in communication with the passageway or aperture 14. Valve means 16 is mounted on a shaft 18 for rotating movement within the aperture 14 of the throttle body means 12 to control the internal combustion engine. Crank arm means 20 is connected to the shaft 18 for driving the valve means 16 in rotation between a first or closed position and a second or open position. Pliant cable means 22 is connected to the crank arm means 20 at an anchor point 24 adjacent one end 26 of the pliant cable means 22. The pliant cable means 22 transmits a force to the crank arm means 20 to control rotation of the valve means 16. The other end of the pliant cable means 22 is typically connected to an operator actuated device, such as a foot operated pedal, or hand operated lever, as is conventional. The throttle body means may define one or more passages or apertures 14 extending therethrough, and the valve means 16 may include one or more valves mounted on the shaft 18 for rotation therewith in response to movement of the crank arm means 20 and pliant cable means 22. Spring means 28 biases the crank arm means 20, connected shaft 18 and valve means 16 to a first position, generally corresponding to the closed position. The crank arm means 20 may also include anchor points 30 and 32 for cruise control system connection and automatic transmission shift control system connection to the crank arm means 20 as is also conventional.

According to the present invention, cam means 34 is connected to the crank arm means 20 for modifying an effective moment arm of force being transmitted between the pliant cable means 22 and the crank arm means 20, such that the moment arm rapidly decreases during a first angular portion of rotation about the shaft 18 from the first or closed position and the moment arm substantially stabilizes during a second angular portion of rotation about the shaft 18 to the second or open position. In the preferred configuration of the cam means 34 illustrated in FIGS. 1–6, the cam means 34 lessens the sensitivity of the throttle valve actuator 10 adjacent the idle position so that it is not as responsive to movement of the pliant cable means 22 through approximately the first 30° to 40° of rotational travel of the crank arm means 20 about the shaft 18. Typically, the pliant cable means 22 has approximately 1½ inches of travel between the idle or first position and the wide open or second position. The entire rotational angular movement of the crank arm means 20, shaft 18 and valve means 16 about the longitudinal axis of the shaft 18 is approximately 85° between the first and second positions.

Figure 10:
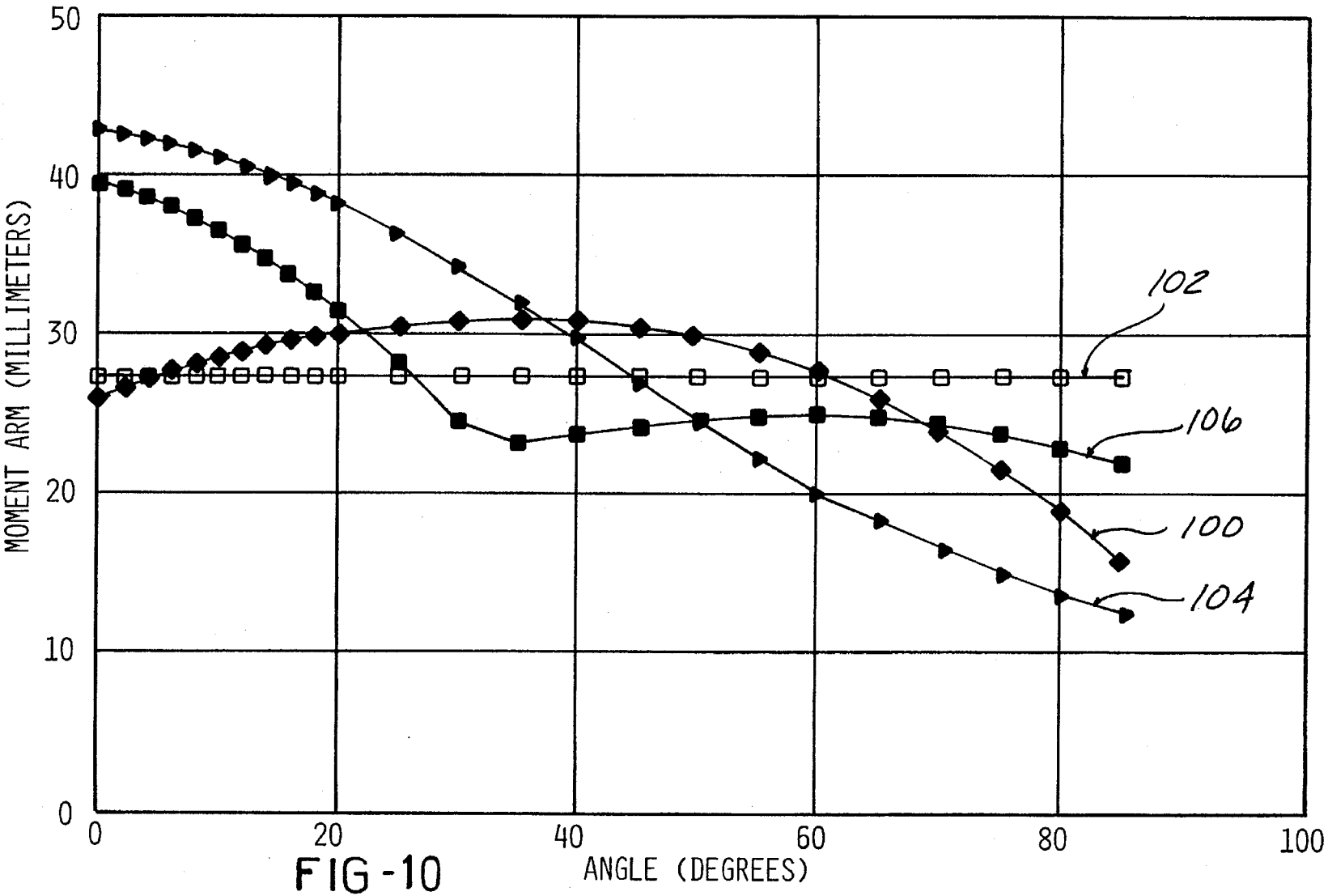
FIG. 10 is a graph illustrating moment arm in millimeters versus angle in degrees for the throttle valve actuator according to the present invention in comparison with three other known throttle valve actuator configurations.

As best seen in FIG. 10, a conventional ball stud connection to the valve actuator is illustrated as curve 100. The standard ball stud connection was overly sensitive in the first angular portion of rotation about the longitudinal axis of the shaft 18 generally corresponding to movement between the 0° position and approximately the 30° or the 40° position of angle as illustrated in the graph depicted in FIG. 10. A conventional constant radius connection to the throttle valve actuator is illustrated in curve or line 102 of the graph. While this improved on the sensitivity during the first angular portion of rotation over the ball stud connection curve 100, it still was overly sensitive in the first angular portion of rotation between the 0° position and approximately the 30° position or approximately the 40° position of angular rotation about the longitudinal axis of shaft 18. A conventional non-linear cam connection has been provided to the throttle valve actuator as illustrated in curve 104. The non-linear cam connection curve 104 proved to provide adequate reduction in the sensitivity of the throttle valve actuator 10 through the first angular portion of rotation about the longitudinal axis of shaft 18, but proved unsatisfactory in the second angular portion of rotation about the longitudinal axis of the shaft 18 from approximately the 30° position or the 40° position of rotation to the second position at approximately the 85° position of rotation as illustrated in the graph of FIG. 10. The continued steep slope of the moment arm with respect to the angle as illustrated in FIG. 10 for the non-linear cam connection curve in the second angular portion of rotation resulted in an undesirable increase in the amount of force required to maintain the throttle valve actuator 10 in the wide open or second position. It is therefore desirable in the present invention to reduce the pedal force required to maintain the throttle valve actuator 10 at the full open or second position. Therefore, according to the present invention, cam means 34, such as a mini cam connection was provided as illustrated in curve 106. According to the present invention, cam means 34 provides a rapidly decreasing moment arm during the first angular portion of rotation about the longitudinal axis of the shaft 18, while providing a generally, substantially constant moment arm during the second angular portion of rotation about the longitudinal axis of the shaft 18. The mini cam connection curve 106 provides the desirable characteristic of lessening the sensitivity of the pedal actuator adjacent the idle position to reduce the possibility of lurching of the vehicle in response to small pedal movements since this is considered undesirable, while reducing the amount of pedal force required to maintain the throttle valve actuator at the full open or second position.

Figure 2:
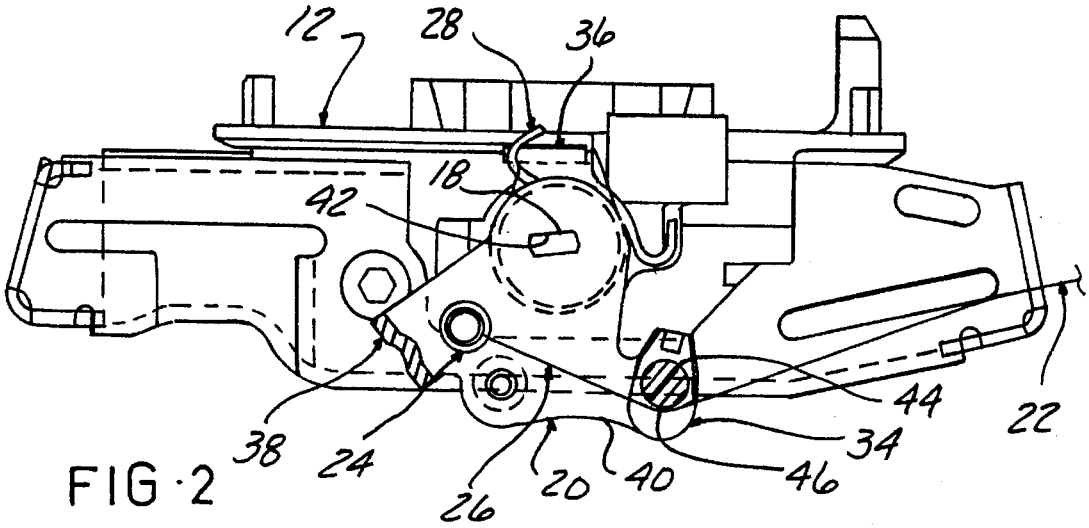
FIG. 2 is a side elevational view of the throttle valve actuator according to the present invention in a closed position.
Figure 3:
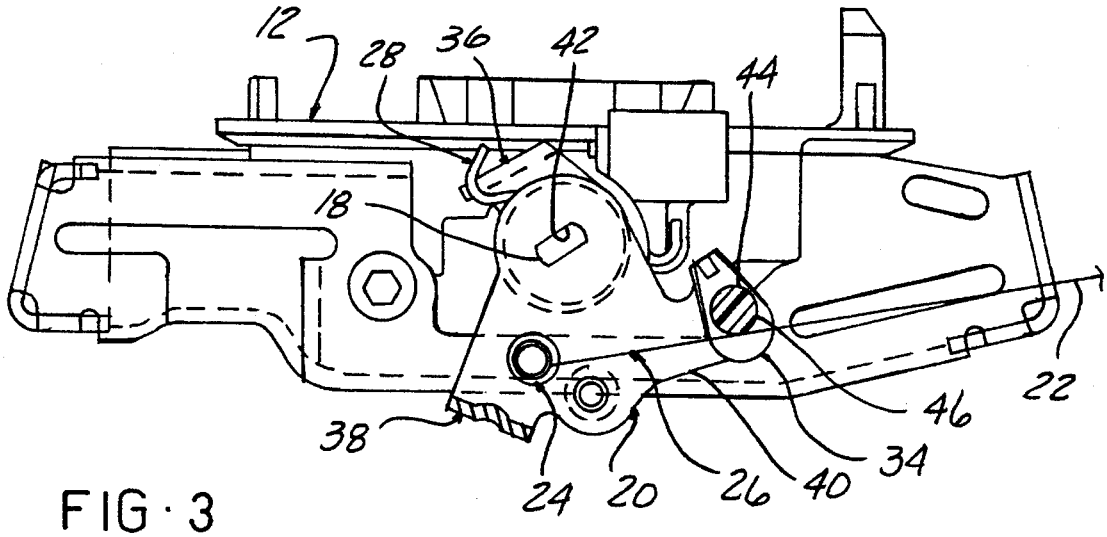
FIG. 3 is a side elevational view of the throttle valve actuator according to the present invention in a partially open position corresponding to the transition point between a first angular portion of rotation about the throttle shaft with rapidly decreasing moment arm and a second angular portion of rotation about the throttle shaft with a generally constant moment arm.
Figure 4:
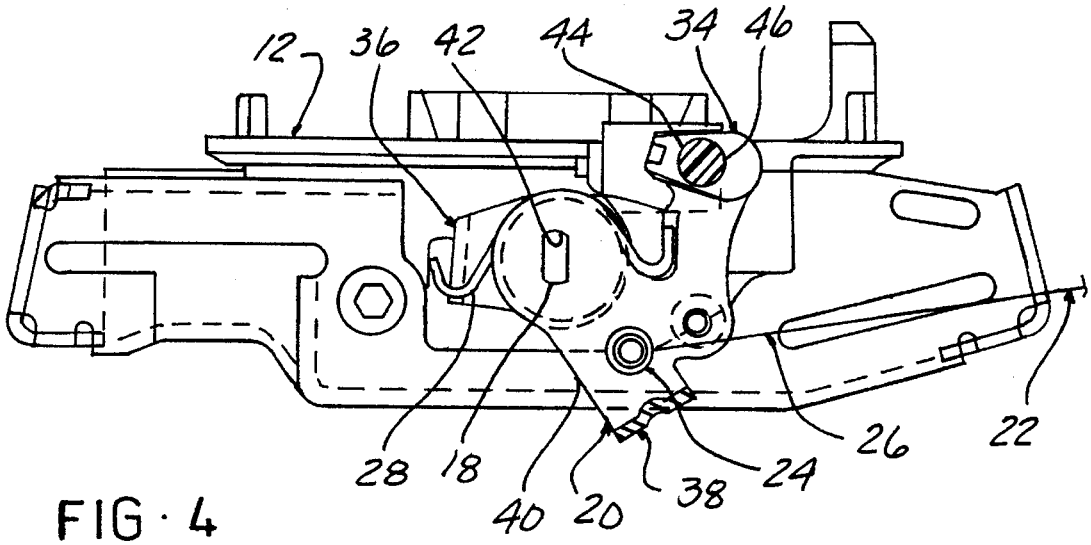
FIG. 4 is a side elevational view of the throttle valve actuator according to the present invention in an open position.

Referring to FIG. 2, the throttle valve actuator 10 is shown in the first or closed position with the cam means 34 engaging with the pliant cable means 32. In FIG. 3, sufficient force has been applied through the pliant cable means 22 to rotate the crank arm means 20, shaft 18 and valve means 16 through a first angular portion of rotation about the longitudinal axis of the shaft 18 to a transition point between the first and second angular portions of rotation generally corresponding to an angular position in a range of between approximately 30° and approximately 40° inclusive, where the cam means 34 disengages from the pliant cable means 22 and further force applied by the pliant cable means 22 acts directly on the cable anchor point 24 of the crank arm means 20. In FIG. 4, sufficient force has been applied through the pliant cable means 22 to rotate the crank arm means 20, shaft 18 and valve means 16 to the second or wide open position, generally corresponding to an angular position of approximately 85° of rotation about the longitudinal axis of the shaft 18 with respect to the closed or first position illustrated in FIG. 2 corresponding to an angular position of 0°. After release of the force acting through the pliant cable means 22, the spring means 28 biases the crank arm means 20 toward the first position as shown in FIG. 2.

Figure 6:
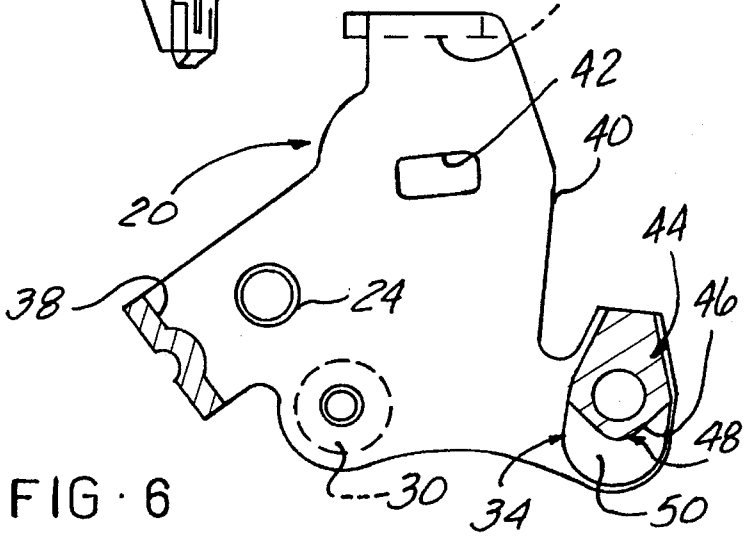
FIG. 6 is a detailed cross-sectional view of the throttle valve actuator taken as shown in FIG. 5.
Figure 5:
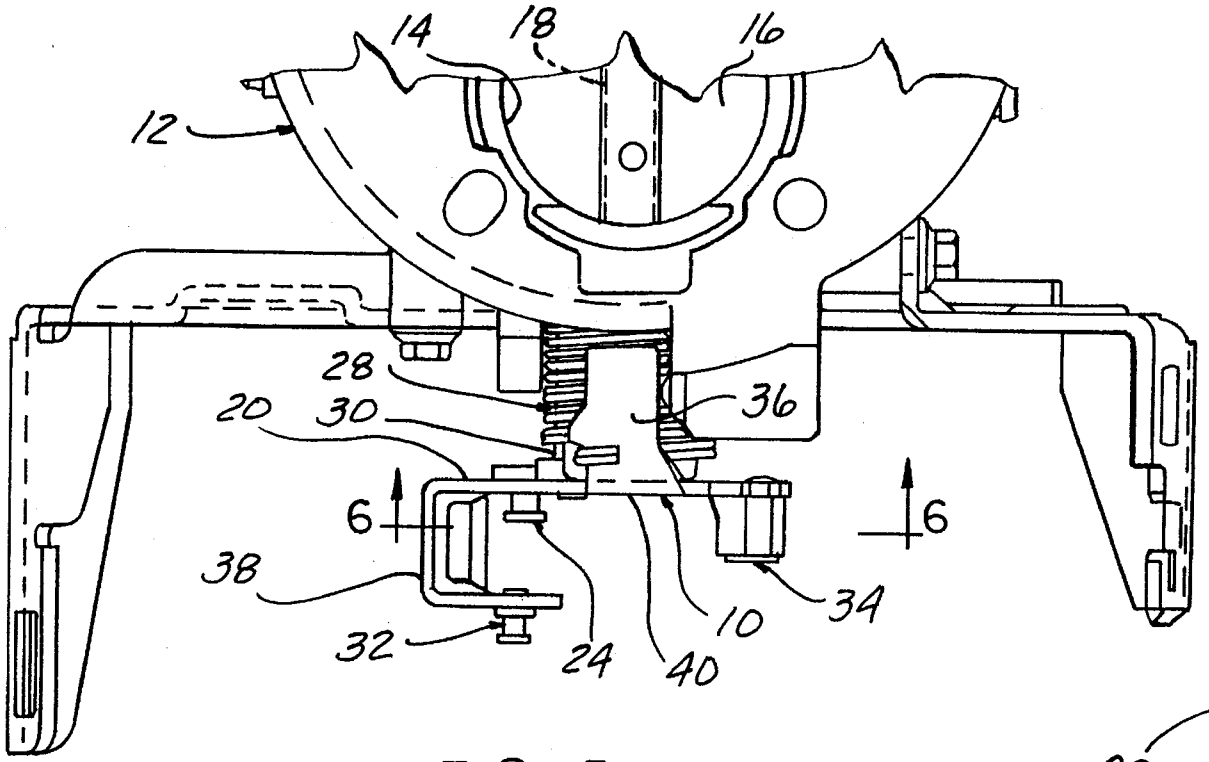
FIG. 5 is a plan view of the throttle valve actuator according to the present invention.

Referring now to FIGS. 5 and 6, the crank arm means 20 can include a first longitudinally extending projection 36 with respect to the longitudinal axis of the shaft 18 for engagement with one end of the spring means 28 for biasing the crank arm means 20 to the first position. A second longitudinally extending projection 38 can be provided for supporting the automatic transmission shift control connection anchor point 32. The first and second projections, 36 and 38 respectively, extend outwardly from a generally planar member 40 of the crank arm means 20. The planar member 40 is generally disposed perpendicular to the longitudinal axis of the shaft 18. The planar member 40 supports the cable anchor point 24 and cruise control system connection anchor point 30. The planar member 40 also includes aperture 42 for receiving an end of the shaft 18 for rotation therewith. The cam means 34 is connected to the planar member 40 and is generally disposed along the path of the longitudinal axis of the pliant cable means 22, so that the cam means 34 engages with the pliant cable means 22 during the first angular portion of rotation about the longitudinal axis of the shaft 18.

The cam means 34 can preferably include a mini cam 44 connected to the crank arm means 20 spaced from the anchor point 24. The mini cam 44 includes a cam surface 46 engageable with the pliant cable means between the first position and the transition point while rotating through the first angular portion of rotation of the crank arm means 20 about the longitudinal axis of the shaft 18. The mini cam 44 modifies the effective moment arm acting on the crank arm means 20 through the pliant cable means 22 while rotating through the first angular portion of rotation about the longitudinal axis of the shaft 18. After passing the transition point, preferably at an angular position in a range of between approximately 30° and approximately 40° inclusive, the cam surface 44 disengages from the pliant cable means 22 and the force of the pliant cable means 22 acts directly on the anchor point 24 to rotate the crank arm means 20 about the longitudinal axis of the shaft 18 through the second angular portion of rotation. This configuration provides the desirable operating characteristic curve 106 as illustrated in FIG. 10.

The cam 46 can be spaced from the anchor point 24 of the pliant cable 22 on the crank arm 20. The cam 46 can also be selectively engageable with the pliant cable 22 during the first angular portion of rotation about the throttle shaft 18 and disengaged from the pliant cable 22 during the second angular portion of rotation about the throttle shaft 18. The cam 46 preferably has a notch or trough-shaped cable guide 48 formed therein for receiving the pliant cable 22 when in at least the closed position of the throttle valve 16. In the preferred embodiment, the notch 48 extends along only a portion of the length of the pliant cable 22 and is spaced from the anchor point 24 of the pliant cable 22 on the crank arm 20. The notch or cable track 48 in the cam 46 can include a trough-shaped guide 48 having a bottom 46 extending along a portion of the longitudinal length of the pliant cable 22 with one end preferably spaced from the anchor point, or alternatively adjacent to the cable connection to the crank arm 20, and a pair of walls 50, 52 extending outwardly from the bottom of the cable guide 48.

Figure 9:
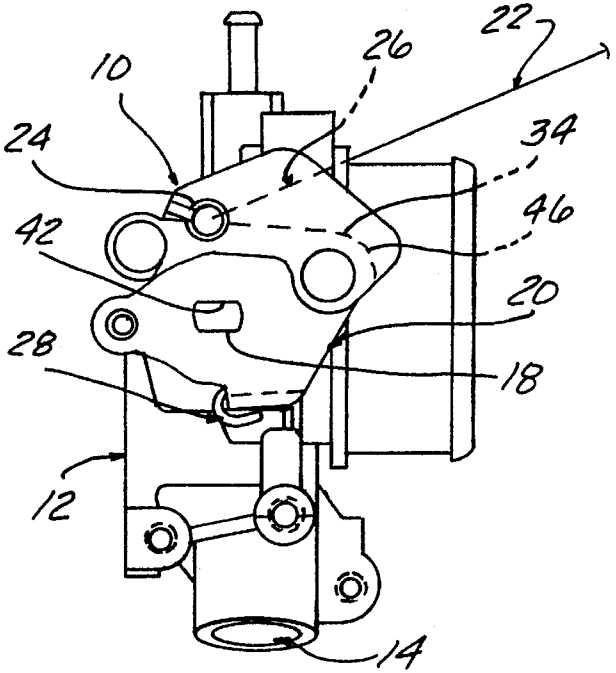
FIG. 9 is a side elevational view of a throttle valve actuator according to the present invention in the open position.
Figure 8:
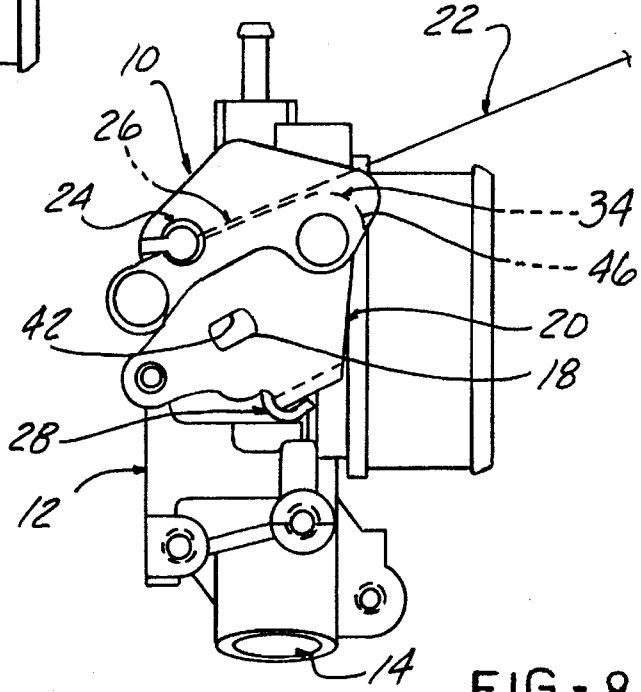
FIG. 8 is a side elevational view of the throttle valve actuator according to the present invention in a partially open position corresponding to a transition between a first angular portion of rotation about the throttle shaft where a moment arm rapidly decreases and a second angular portion of rotation about the throttle shaft where the moment arm remains generally constant.
Figure 7:
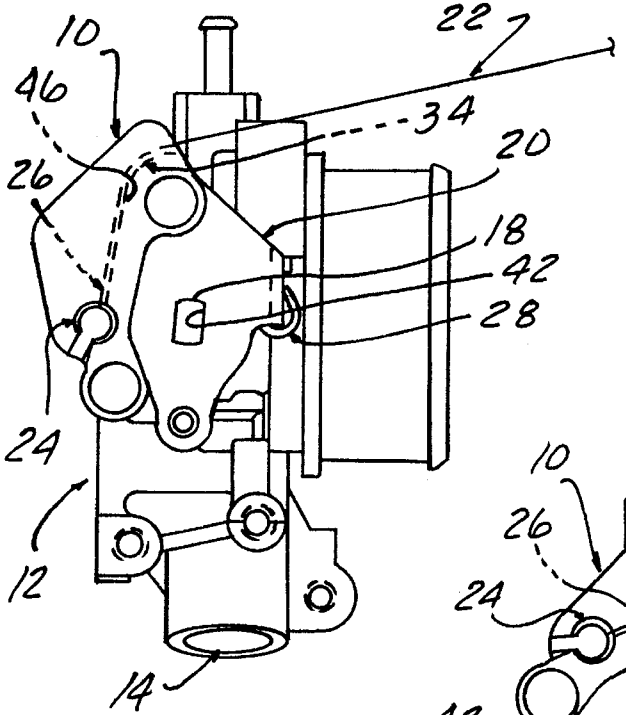
FIG. 7 is a side elevational view of an alternative configuration for the throttle valve actuator according to the present invention in a closed position.

The cam means 34 can also be provided as illustrated in FIGS. 7–9. In FIG. 7, the throttle valve actuator 10 is shown in the closed or first position with the cam surface 46 selectively engageable with the pliant cable means 22 during the first angular portion of rotation about the longitudinal axis of shaft 18 and disengaged from the pliant cable means 22 during the second angular portion or rotation about the longitudinal axis of the shaft 18. In this configuration, the cam surface 46 extends to a position adjacent the anchor point 24 of the pliant cable means 22. As illustrated in FIG. 8, the application of force through the pliant cable means 22 to the crank arm means 20 causes rotation about the longitudinal axis of shaft 18 to a transitional point generally corresponding to an angular position in a range between approximately 30° and approximately 40° inclusive, where the pliant cable means 22 disengages from the cam surface 46 during further rotation in the same direction. The portion of the cam surface 46 spaced from the anchor point 24 provides a first angular portion of rotation about the longitudinal axis of the shaft 18 where the moment arm rapidly decreases between the positions shown in FIG. 7 and FIG. 8. As shown in FIG. 9, the pliant cable means 22 disengages from the cam surface 46 disposed adjacent to the anchor point 24 when rotating passed the position illustrated in FIG. 8 to the full open or second position illustrated in FIG. 9. This configuration provides a second angular portion of rotation about the longitudinal axis of the shaft 18 to the open or second position where the moment arm of force is generally or substantially stabilized to a relatively constant value as illustrated in curve 106 of FIG. 10.

Curve 106 in FIG. 10 illustrates a slight increase in the moment arm during a first part of the second angular portion of rotation about the longitudinal axis of the shaft 18 generally between the transition point and approximately the 60° angle position. Curve 106 further illustrates a slight decrease in the moment arm during a second part of the second angular portion of rotation about the longitudinal axis of shaft 18 corresponding generally to movement between approximately 60° and the second or closed position at approximately 85°.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A throttle valve actuator for an internal combustion engine comprising:

throttle body means for defining an aperture extending therethrough to deliver a charge to a combustion chamber in communication with said aperture;

valve means mounted on a shaft for rotating within said aperture of said throttle body means to control said internal combustion engine;

crank arm means connected to said shaft for driving said valve means in rotation between a closed position and an open position;

pliant cable means connected to said crank arm means at an anchor point adjacent one end of said pliant cable means, said pliant cable means for transmitting a force to said crank arm means to control rotation of said valve means; and cam means connected to said crank arm means for modifying an effective moment arm of force being transmitted between said pliant cable means and said crank arm means, such that said moment arm rapidly decreases during a first angular portion of rotation about said shaft from the closed position and substantially stabilizes during a second angular portion of rotation about said shaft to said open position.

2. The throttle valve actuator of claim 1 further comprising:

said cam means spaced from said anchor point of said pliant cable means on said crank arm means.

3. The throttle valve actuator of claim 1 further comprising:

said first angular portion of rotation about said shaft being in a range of approximately 30° to 40° inclusive.

4. The throttle valve actuator of claim 1 further comprising:

said second angular portion of rotation about said shaft being in a range of approximately 45° to 55° inclusive.

5. The throttle valve actuator of claim 1 further comprising:

said closed position disposed at an angular orientation approximately 85° from said open position about said shaft.

6. The throttle valve actuator of claim 1 further comprising:

said cam means selectively engageable with said pliant cable means during said first angular portion of rotation about said shaft and disengaged from said pliant cable means during said second angular portion.

7. The throttle valve actuator of claim 1 further comprising:

said moment arm increases slightly during a first part of said second angular portion of rotation about said shaft.

8. The throttle valve actuator of claim 7 further comprising:

said moment arm decreases slightly during a second part of said second angular portion of rotation about said shaft.

9. The throttle valve actuator of claim 1 further comprising:

said cam means having a trough-shaped cable guide extending along at least a portion of a length of said pliant cable means spaced from said anchor point on said crank arm means.

10. The throttle valve actuator of claim 9 further comprising:

said guide having a bottom and outwardly extending walls for selectively engaging said pliant cable means through at least one of said first and second angular portions of rotation about said shaft.

11. The throttle valve actuator of claim 10 further comprising:

said guide elongated to extend with one end adjacent to said anchor point.

12. In a throttle valve actuator for an internal combustion engine including a throttle body defining at least one passageway extending therethrough to deliver a charge to said internal combustion engine, at least one valve mounted on a shaft for rotation therewith within said at least one passageway of said throttle body to control said internal combustion engine, a crank arm connected to said shaft for driving said at least one valve in rotation between a first position and a second position, a pliant cable connected to said crank arm at an anchor point adjacent one end of said pliant cable, said pliant cable transmitting a force to said crank arm to control rotation of said at least one valve, the improvement comprising:

a cam connected to said crank arm and engageable with said pliant cable to modify an effective moment arm of force being transmitted between said pliant cable and said crank arm, such that said moment arm rapidly decreases during a first angular portion of rotation about said shaft from the first position corresponding to a 0° angular position through an angular rotational range of approximately 30° to 40° inclusive to a transition point where said moment arm substantially stabilizes during a second angular portion of rotation about said shaft from said transition position to said second position corresponding to approximately an 85° angular position.

13. The throttle valve actuator of claim 12 further comprising:

said cam spaced from said anchor point of said pliant cable on said crank arm.

14. The throttle valve actuator of claim 12 further comprising:

said cam selectively engageable with said pliant cable during said first angular portion of rotation about said shaft and disengaged from said pliant cable during said second angular portion.

15. The throttle valve actuator of claim 12 further comprising:

said moment arm increases slightly during a first part of said second angular portion of rotation about said shaft.

16. The throttle valve actuator of claim 15 further comprising:

said moment arm decreases slightly during a second part of said second angular portion of rotation about said shaft.

17. The throttle valve actuator of claim 12 further comprising:

said cam having a trough-shaped cable guide extending along at least a portion of a length of said pliant cable spaced from said anchor point on said crank arm.

18. The throttle valve actuator of claim 17 further comprising:

said guide having a bottom and outwardly extending walls for selectively engaging said pliant cable through at least one of said first and second angular portions of rotation about said shaft.

19. The throttle valve actuator of claim 18 further comprising:

said guide elongated to extend with one end adjacent to said anchor point.

20. A throttle valve actuator for an internal combustion engine comprising:

a throttle body defining at least one passageway extending therethrough to deliver a charge to said internal combustion engine;

at least one valve mounted on a shaft for rotation therewith within said at least one passageway of said throttle body to control said internal combustion engine;

a crank arm connected to said shaft for driving said at least one valve in rotation between a first position and a second position;

a pliant cable connected to said crank arm at an anchor point adjacent one end of said pliant cable, said pliant cable transmitting a force to said crank arm to control rotation of said at least one valve;

a cam connected to said crank arm and engageable with said pliant cable to modify an effective moment arm of force being transmitted between said pliant cable and said crank arm, such that said moment arm rapidly decreases during a first angular portion of rotation about said shaft from the first position corresponding to a 0° angular position through an angular rotational range of approximately 30° to 40° inclusive to a transition point where said moment arm substantially stabilizes during a second angular portion of rotation about said shaft from said transition position to said second position corresponding to approximately an 85° angular position, said cam spaced from said anchor point of said pliant cable on said crank arm, said cam selectively engageable with said pliant cable during said first angular portion of rotation about said shaft and disengaged from said pliant cable during said second angular portion, such that said moment arm increases slightly during a first part of said second angular portion of rotation about said shaft and said moment arm decreases slightly during a second part of said second angular portion of rotation about said shaft, said cam having a trough-shaped cable guide extending along at least a portion of a length of said pliant cable spaced from said anchor point on said crank arm, said guide having a bottom and outwardly extending walls for selectively engaging said pliant cable through at least one of said first and second angular portions of rotation about said shaft.

* * * * *